US005226795A

United States Patent [19]

Kraemer

[11] Patent Number: 5,226,795

[45] Date of Patent: Jul. 13, 1993

[54] ADJUSTABLE GOVERNOR PLATE FOR INTERNAL COMBUSTION ENGINES

[75] Inventor: Manfred Kraemer, Schwieberdingen, Fed. Rep. of Germany

[73] Assignee: Robert Bosch GmbH, Stuttgart, Fed. Rep. of Germany

[21] Appl. No.: 967,499

[22] Filed: Oct. 28, 1992

[30] Foreign Application Priority Data

Nov. 4, 1991 [DE] Fed. Rep. of Germany ..... 4136298

[51] Int. Cl.[5] ..... F04B 7/04; F02D 33/00

[52] U.S. Cl. ..... 417/499; 123/373; 123/374

[58] Field of Search ..... 417/490, 494, 499; 123/373, 374, 367, 368, 495

[56] References Cited

U.S. PATENT DOCUMENTS

| | | | |
|---|---|---|---|
| 2,200,459 | 5/1940 | Thomas | 123/373 |
| 3,338,224 | 8/1967 | Isley et al. | 123/374 |
| 4,989,571 | 2/1991 | Güentert et al. | 123/495 |
| 5,148,789 | 9/1992 | Shiraishi et al. | 123/367 |

FOREIGN PATENT DOCUMENTS

| | | | |
|---|---|---|---|
| 61-33967 | 12/1986 | Japan . | |
| 992772 | 1/1983 | U.S.S.R. | 123/367 |
| 237710 | of 1924 | United Kingdom | 123/373 |

*Primary Examiner*—Richard A. Bertsch
*Assistant Examiner*—Roland McAndrews
*Attorney, Agent, or Firm*—Edwin E. Greigg; Ronald E. Greigg

[57] ABSTRACT

A fuel injection pump for internal combustion engines is proposed, having a reciprocating piston that defines a pump work chamber in a pump cylinder and that on its jacket face has a control recess communicating with the pump work chamber, and a control slide is displaceable on the pump piston in order to control the high-pressure pumping. This control slide, which cooperates with the control recess on the pump piston, is actuated via an adjusting lever disposed on an adjusting lever shaft; the adjusting lever shaft is moved by an adjusting lever mounted on it outside the housing. This adjusting lever can be pivoted between two stops; according to the invention, these stops are disposed on a base plate that simultaneously acts as a flange of the adjusting lever shaft bearing bush and that can be moved relative to the pump housing via oblong slots in order to adjust the stops.

2 Claims, 2 Drawing Sheets

ADJUSTABLE GOVERNOR PLATE FOR INTERNAL COMBUSTION ENGINES

BACKGROUND OF THE INVENTION

The invention is directed to improvements in a fuel injection pump. One such fuel injection pump is known from Japanese Utility Model Application 61-33967. In it, fuel pumping is effected by a reciprocating pump piston that defines a pump work chamber in a pump cylinder and has a diversion groove, communicating with the pump work chamber, on its jacket face. The onset and end of high-pressure pumping are controlled by a control slide that is axially displaceable on the pump piston in a recess in the pump cylinder and cooperates with the diversion groove of the pump piston. The control slide is actuated via an adjusting lever disposed on an adjusting lever shaft, and the shaft communicates with an actuator that trips the adjusting motion and is disposed outside the pump housing. Serving as stops for the adjusting motion of this external actuator n the form of a lever mounted on the adjusting lever shaft are two adjusting screws in the pivoting range of the lever, each of the screws being joined to the pump housing via an angle plate. This option for setting the upper and lower stop for the adjusting motion of the control slide has the disadvantage that unintended adjustment during operation of the fuel injection pump cannot be precluded. In addition, in this arrangement it is possible only with major precision adjustment effort to keep the spacing between the upper and lower stops, which corresponds to the total control slide movement, suitably constant upon an adjustment, since the two stops have to be precision-adjusted separately. Another disadvantage arises in installation of the fuel injection pump; the control slide may become detached as long as the positioner has not yet been installed, which in turn entails increased installation effort and expense.

OBJECT AND SUMMARY OF THE INVENTION

It is a principal object of the fuel injection pump to provide the advantage over the prior art that the stops for the maximum adjustment of the control slide to late and early, i.e. retardation and advancement, respectively, are disposed on a base plate serving as a stop plate and located outside the pump housing.

It is another object of the invention that this base plate is advantageously connected to the pump housing via oblong slots, so that an adjustment of the location of the stops can be done with little effort. The previously ascertained maximum stroke of the control slide remains constant because of the fixed connection of the stop.

It is yet another object of the invention that the fixed disposition of the stops on the base plate and their screw fastening in the pump housing also provide the advantage of a location that is secured against twisting, which is necessary for safe, precise function of the fuel injection pump over its entire service life.

In still another object of the invention, a further advantage of the fuel inject pump of the invention is that the base plate that receives the stop is simultaneously embodied as a flange of the adjusting lever shaft bearing bush. As a result, the adjusting lever and control slide are already fixed in their location, via the adjusting lever shaft, prior to installation of the positioner, which avoids detachment of the control slides and hence increased installation effort and expense.

The invention will be better understood and further objects and advantages thereof will become more apparent from the ensuing detailed description of preferred embodiments taken in conjunction with the drawings.

DESCRIPTION OF THE PREFERRED EMBODIMENTS

The description of the exemplary embodiments shown in FIGS. 1–4 will be limited to the components of a known fuel injection pump that serves to explain the invention.

Figure 1:
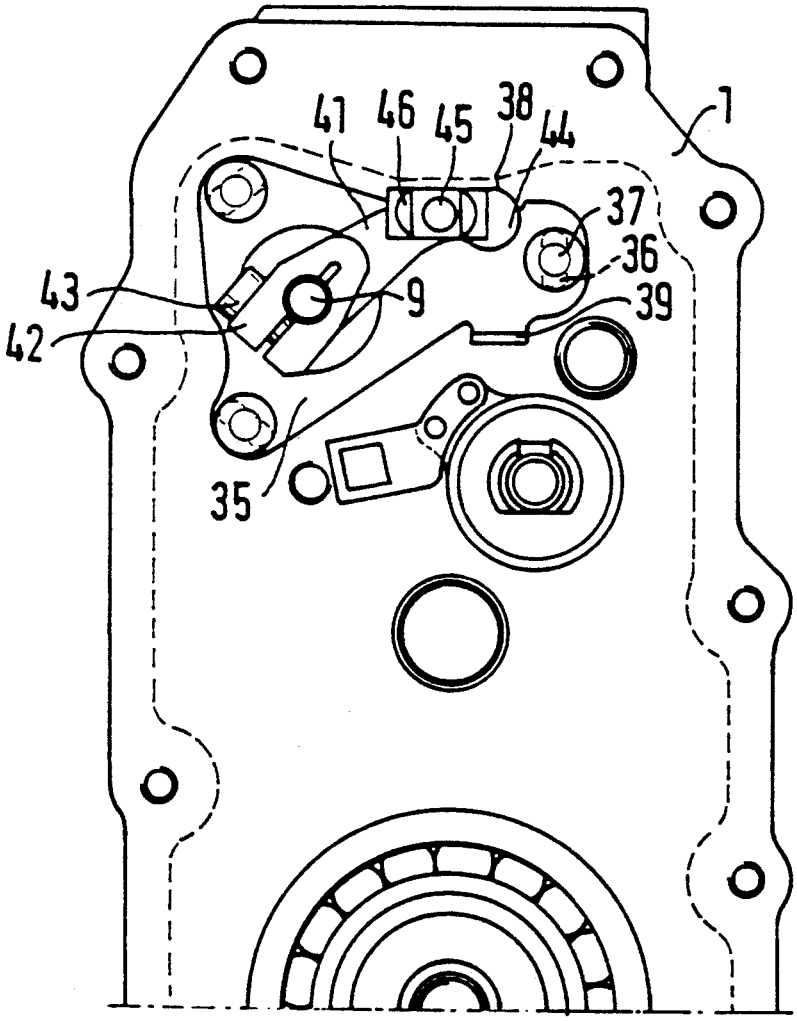
FIG. 1 is a side view of the fuel injection pump according to the invention on the side of the pump housing on which the positioner for actuating the adjusting lever shaft is disposed.
Figure 2:
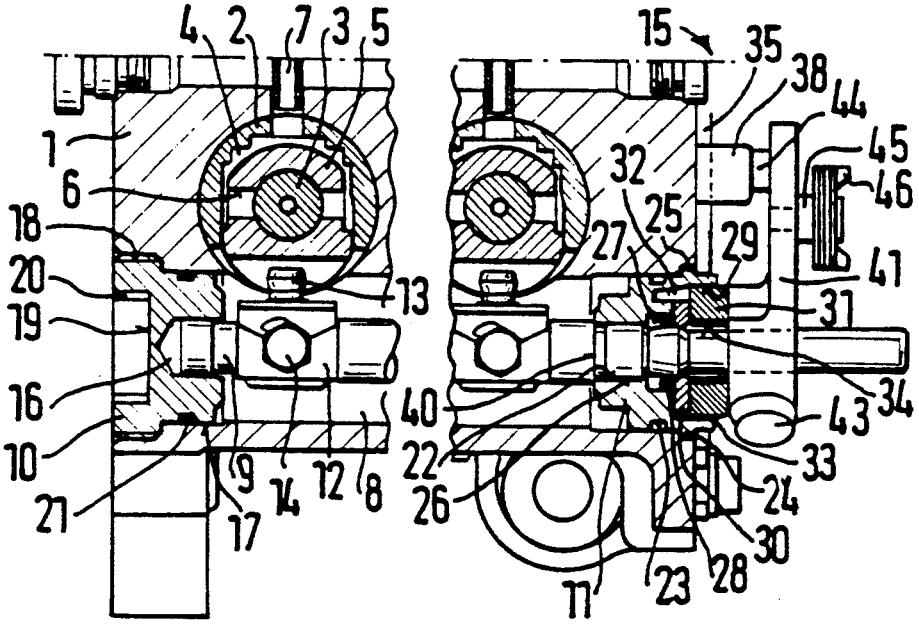
FIG. 2 is a detail of the cross section through the fuel injection pump along the adjusting lever shaft.

In the fuel injection pump shown in FIGS. 1 and 2, a plurality of pump cylinders 2 are led into a housing 1, and one pump piston 3 is axially moved by a camshaft in each of the cylinders; on its jacket face, not shown, each piston 3 has a control recess, which communicates via a conduit with the pump work chamber, likewise not shown. Recesses in the pump cylinders 2 form partial suction chambers 4, each of which are assigned to one pump element, comprising a pump cylinder 2 and a pump piston 3. In each of these partial suction chambers 4, one control slide 5 is disposed for axially displaceable movement on the pump piston 3 and has a radial bore 6 for opening up the control recess upon a pump piston stroke predetermined by the position of the control slide 5. The various partial suction chambers 4 are supplied with fuel from fuel feed lines 7 and discharge on the outlet side into a main suction chamber 8 extending across the length of the housing 1, this chamber 8 being closed on its ends. An adjusting shaft 9 is disposed in the main suction chamber 8, being rotatably supported in two bearing bushes 10, 11 that close off the main suction chamber 8; the control slides 5 are displaceable by this adjusting shaft 9. To that end, adjusting sleeves 12 each having one adjusting lever 13 are disposed on the adjusting lever shaft 9 at the level of each pump cylinder 2; each lever 13 engages a groove, not shown in detail, of the control slide 5 and thus converts the rotary motion of the adjusting lever shaft 9 into an axial reciprocating motion of the control slide 5. For accurate adjustment of the location of the adjusting lever 13, the adjusting lever sleeve 12 can be tightened on the adjusting lever shaft 9 via a tightening screw 14.

The bearing bushes 10, 11 that receive the adjusting lever shaft 9 are different from one another. The left-hand bearing bush 10, on the side of the housing 1 farther away from a positioner 15 for actuating the adjusting lever shaft 9, guides the adjusting lever shaft 9 in a blind bore 16. Bearing bush 10 has a stepped outside diameter, the tapered part 17 of which is guided in the main suction chamber 8, while the larger outside diameter is screwed into the pump housing 1; on the side of the bearing bush 10 remote from the blind bore 16, there is an indentation 19, with a profile 20 made in its inside wall surface; a tool for screwing in the bearing bush 10 can engage this profile. One advantage of this embodiment is that the bearing bush 10 is screwed all the way into the housing 1 and thus provides a flat surface on the outer housing wall, which has advantages in turn for installation purposes. For sealing off from the main suction chamber 8, a groove in which a sealing ring 21 is guided is disposed on the circumference of the tapered part 17 that protrudes into the main suction chamber 8.

On the side of the housing on which the positioner 15 for actuating the adjusting lever shaft 9 is disposed, the right-hand bearing bush 11 opposite the left-hand bearing bush 10 has, by comparison, a through bore 22, in which the adjusting lever shaft 9 is so guided as to protrude out of the pump housing; via a shaft shoulder 40 created by a diameter reduction, the shaft 9 comes to rest on the bearing bush 11. The outer diameter of the bearing bush 11 is stepped, and the larger outer diameter has an annular groove 23 for receiving a sealing ring, and also has an annular collar 24. The bearing bush 11 is guided via its larger outside diameter in the main suction chamber 8 and via the collar 24 comes to rest on a shoulder 25 on the pump housing 1. The diameter of the through bore 22 of the bearing bush 11 is stepped twice: The smallest diameter 26 guides the adjusting lever shaft 9; a diameter 27 that is larger than this smallest diameter receives a shaft sealing ring 28 seated on the adjusting lever shaft 9 and a disk 30 and a screw ring 31 are disposed in a diameter 29 that is markedly larger than the middle diameter 27.

The disk 30 is secured against twisting via a pin 32 introduced into the bearing bush 11 in order, during the process of screwing the screw ring 31 adjoining it into the through bore 22 of the bearing bush 11, to prevent the disk 30 from rotating as well and to prevent an attendant tightening of the shaft sealing ring 28 resting on the disk 30. The screw ring 31 is screwed into the bearing bush 11 via a male thread 33 disposed on its circumference; its inside diameter has a hexagonal profile 34 that can be engaged by a screwdriving tool. On the side of the collar 24 remote from the main suction chamber 8, a base plate 35 is connected to the bearing bush 11, radially gripping it around its circumference and thus at the same time forming a flange of the bearing bush 11. The base plate 35 is preferably hard-soldered to the bearing bush 11. The base plate 35 is adjustably joined to the housing 1 via three oblong slots 36 and three screws 37, and it has two stops 38, 39, bent at an angle from the base plate 35, in the pivoting range of an adjusting lever 41 that borders the screw ring 31 and is disposed on the protruding end of the adjusting lever shaft 9.

This adjusting lever 41 is secured on the adjusting lever shaft 9 via a clamp part 42 and a tightening screw 43 screwed into it; the clamp part 42 and the adjusting lever shaft 9 may advantageously have a toothed profile, to preclude the possibility that the adjusting lever 41 may slip out of the adjusting lever shaft 9. On the head of the adjusting lever 41 is disposed a cylinder 44, by way of which the adjusting lever 41 comes to rest on the stops 38, 39; the stop 38 defines the maximum late location and the stop 39 the maximum possible advancement to early of the control slide 5. The adjusting lever 41, which causes the rotary motion of the adjusting lever shaft 9, is actuated in turn by a positioner 15, in the course of which a sliding block 46 attached to the adjusting lever 41 via a bolt 45 slides in a guide of an actuator, not shown.

Figure 3:
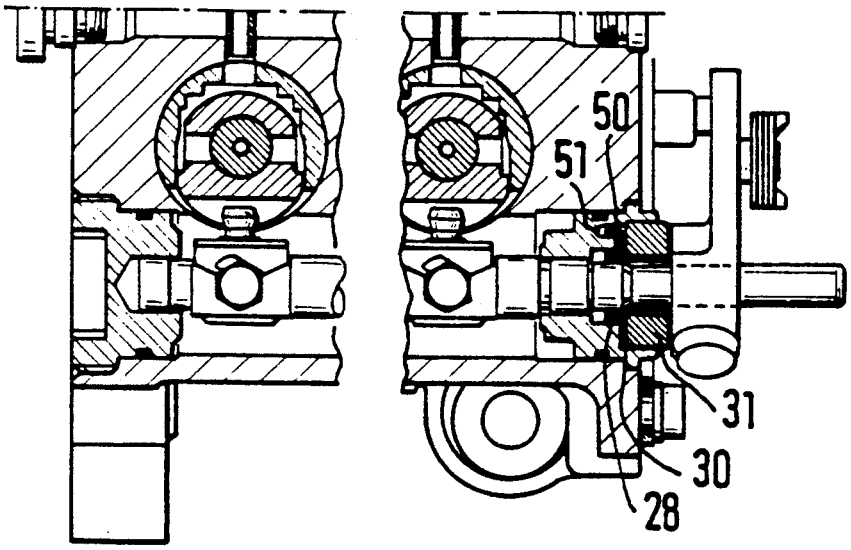
FIG. 3, analogously to FIG. 2, is a cross-sectional view with a further embodiment of the disk in the adjusting lever shaft bearing bush adjoining the positioner.

The exemplary embodiment shown in FIG. 3 differs from that shown in FIGS. 1 and 2 only in the form of the disk 30. Here, the pin 32 can be dispensed with, because the security against twisting is performed by part of the disk 30 itself. To that end, two very close-together parallel slits are made from the circumference into the disk 30, and the resultant segment 50 is bent at a right angle. This segment 50 engages a coaxial blind bore on the face of the bearing bush 11 that borders the disk 30, and thus prevents a torsional motion of the disk 30 relative to the bearing bush 11.

Figure 4:
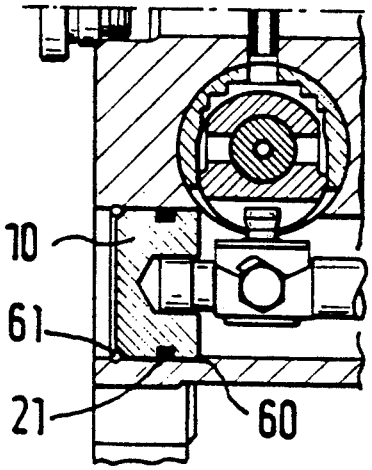
FIG. 4 shows a further variant of the adjusting lever shaft bearing, again in a view analogous to FIG. 2.

The exemplary embodiment shown in FIG. 4 shows an alternative embodiment of the bearing bush 10. This bearing bush 10, which receives the adjusting lever shaft 9 in the blind bore 16, is in contrast to FIG. 2 now screwed into the housing 1; instead, it is fixed in its axial location by a housing shoulder 60 and a snap ring 61 on the outer diameter.

The fuel injection pump described above functions as follows: during the intake stroke of the pump piston 3, fuel flows via the fuel inlet 7, the partial suction chamber 8, the control recess and the conduit in the interior of the pump piston, into the pump work chamber. Upon the ensuing pumping stroke of the pump piston 3, the pressure necessary for the injection builds up in the pump work chamber after the control recess has plunged into the control slide 5, and injection takes place. While the supply quantity is determined here via the rotary position of the pump piston 3 and its oblique control recess, which is thus made to communicate earlier or later after the onset of high-pressure pumping with the radial bore 6 of the control slide 5 for relief of the pump work chamber, the instance of the onset and end of high-pressure pumping are fixed by the axial location of the control slide 5. Once the control recess communicates with the radial bore 6, the fuel flows out of the pump work chamber into the main suction chamber 8 and no fuel attains injection. The control slide 5 is moved axially by the adjusting lever 13 disposed on the adjusting lever shaft 9; the adjusting lever shaft 9 in turn is actuated via an adjusting lever 41 that is connected to an actuator by the sliding block 46.

This adjusting lever 41 is pivoted between the stop 38 for the maximum late location (maximum upper location on the pump piston) of the control slide 5 and the stop 39 for its maximum adjustment to early (maximum lower location on the pump piston). For optimal adaptation of the fuel injection pump to the engine to be supplied, the stops 38, 39 are adjustable, and their spacing from one another, which defines the maximum control slide stroke and thus the adjustment width of the injection onset adjustment and high-pressure pumping onset adjustment, remains constant.

The foregoing relates to preferred exemplary embodiments of the invention, it being understood that other variants and embodiments thereof are possible within the spirit and scope of the invention, the latter being defined by the appended claims.

We claim:

1. A fuel injection pump for internal combustion engines having at least one reciprocating pump piston (3), which defines a pump work chamber in a pump cylinder (2) disposed in a pump housing (1) and on its jacket face has a control slide (5) that is axially adjustable to control high-pressure pumping, the control slide being actuated via an adjusting lever shaft (9) supported in the pump housing via adjusting lever shaft bearing bush means (11), said adjusting lever shaft being rotated by means of an adjusting lever (41) mounted on an end thereof protruding from the pump housing (1) and pivotable between two stops (38, 39), the stops (38, 39) are disposed on a base plate (35) that is detachably joined to the pump housing of the fuel injection pump and is adjustable, and said base plate simultaneously forms a flange to restrict axial movement of said adjusting lever shaft bearing bush means (11).

2. A fuel injection pump as defined by claim 1, in which the base plate (35) forming the stops (38, 39) is screwed to the pump housing (1), and the base plate (35) includes means defining apertures (36) to receive screws (37), which apertures are embodied as oblong slots.

* * * * *